United States Patent [19]

Booth

[11] 4,385,482

[45] May 31, 1983

[54] MULTIPLE STATION PACKAGING MACHINE AND METHOD FOR PACKAGING

[75] Inventor: John L. Booth, Richton Park, Ill.

[73] Assignee: Booth Manufacturing Company, Fort Pierce, Fla.

[21] Appl. No.: 169,625

[22] Filed: Jul. 16, 1980

[51] Int. Cl.[3] ..... B65B 35/38

[52] U.S. Cl. ..... 53/538; 53/543; 53/240; 53/247; 53/251

[58] Field of Search ..... 53/448, 475, 534, 537, 53/538, 543, 539, 244, 246, 247, 251, 240

[56] References Cited

U.S. PATENT DOCUMENTS

| | | | |
|---|---|---|---|
| 3,453,802 | 7/1969 | Riddington | 53/538 X |
| 3,553,926 | 1/1971 | Zwiacher et al. | 53/538 X |
| 3,613,330 | 10/1971 | Voullaire | 53/475 X |
| 3,685,624 | 8/1972 | Paddock | 53/244 X |
| 3,834,115 | 9/1974 | Johnson et al. | 53/537 X |
| 4,203,274 | 5/1980 | Warkentin et al. | 53/244 X |
| 4,233,802 | 11/1980 | Booth et al. | 53/538 X |

*Primary Examiner*—Horace M. Culver

*Attorney, Agent, or Firm*—Dressler, Goldsmith, Shore, Sutker & Milnamow, Ltd.

[57] ABSTRACT

A packaging machine and method for automatically packaging articles such as fruit one layer at a time into containers is provided. Means are provided for disposing the articles in a nested relationship at several supply positions. Means are also provided for situating containers at loading stations adjacent to said supply positions. The articles are lifted from the supply positions and deposited into the containers at the loading positions. Each array of articles comprises a separate layer in a box or container. After such layers are deposited simultaneously at each of said loading stations, the boxes are advanced to the next loading station wherein the cycle is repeated until the container is filled. Preferably, a number of supply and loading positions and containers is equal to the number of layers which will fit into the box, so that the net result is having one box filled for each machine cycle.

4 Claims, 27 Drawing Figures

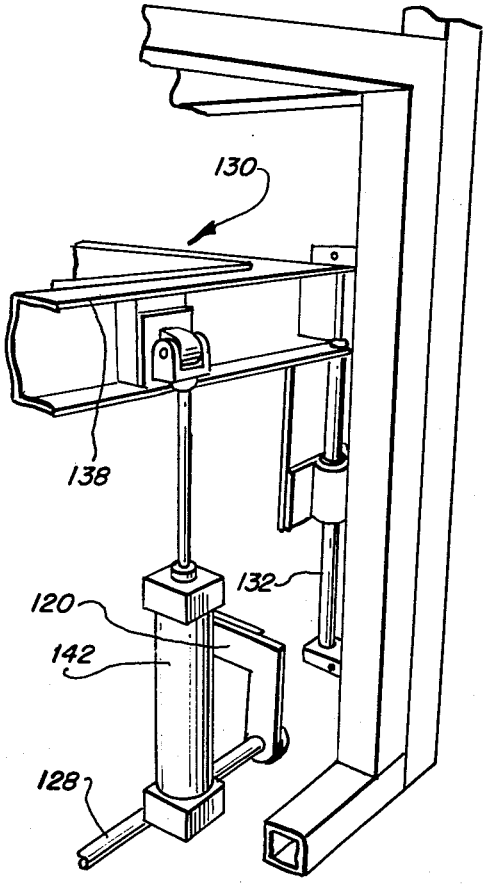
FIG. 5
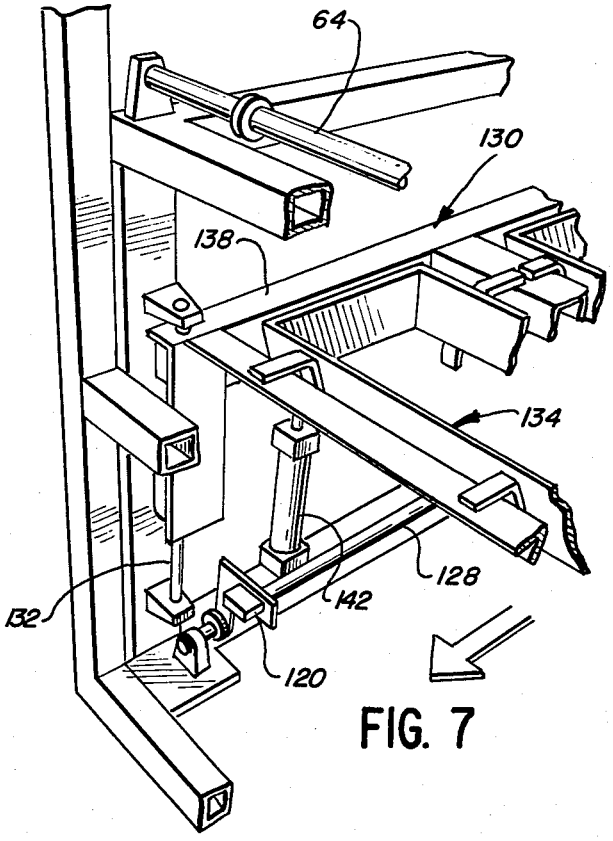
FIG. 7
FIG. 6
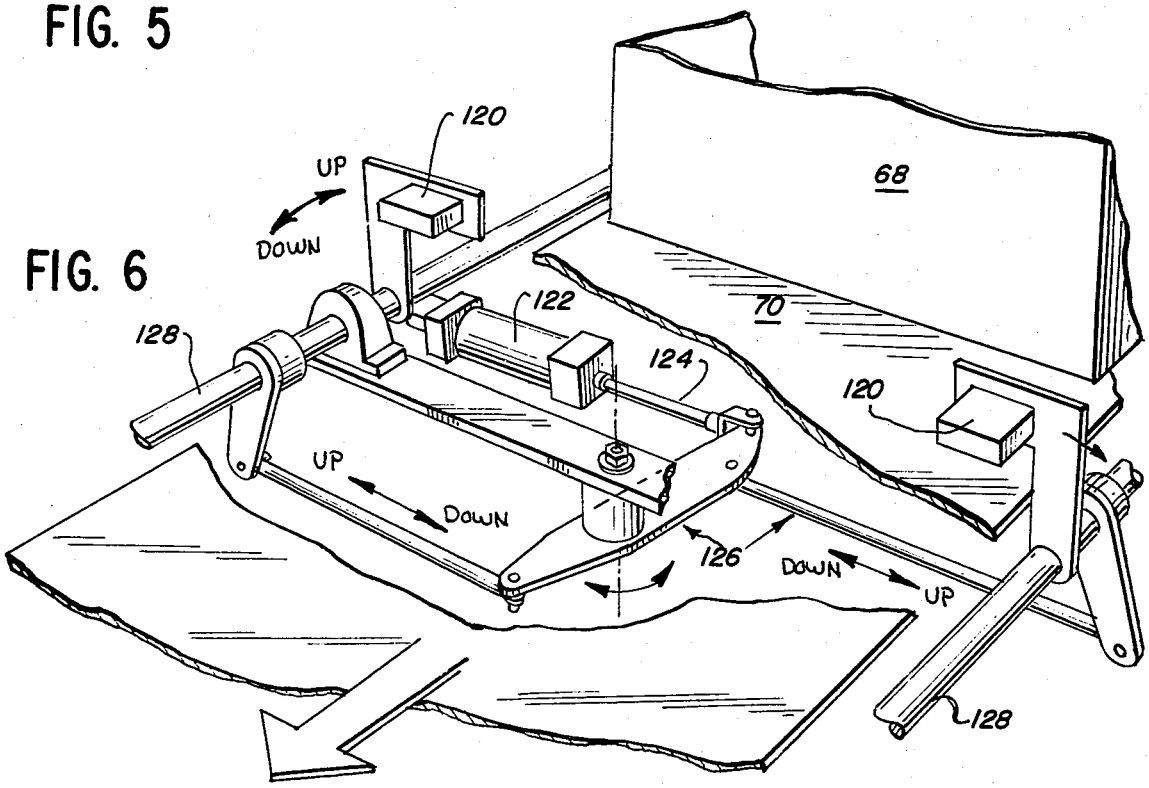

FIG. 8
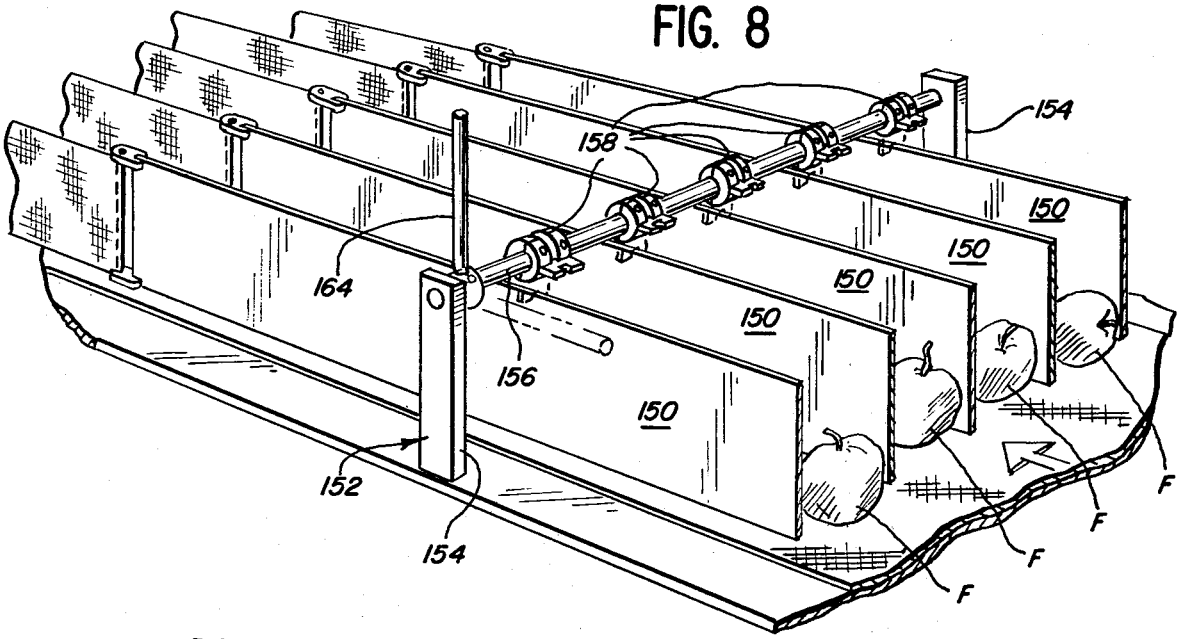
FIG. 9
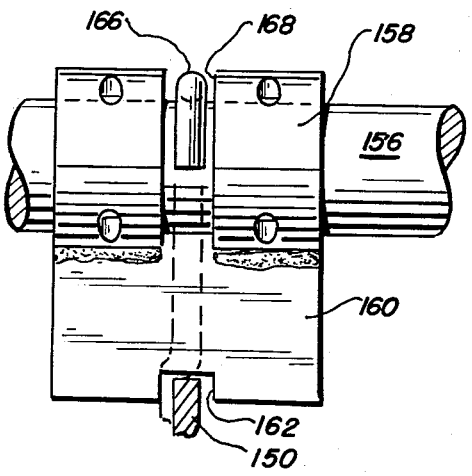
FIG. 11
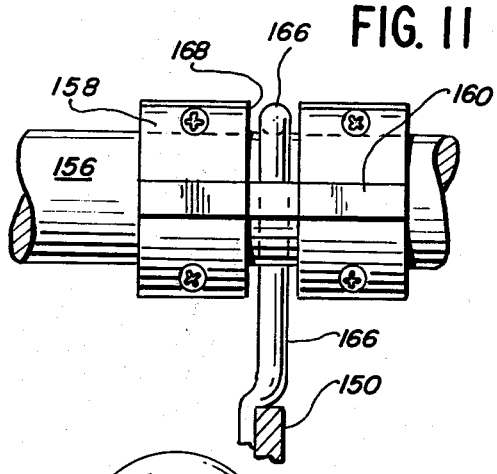
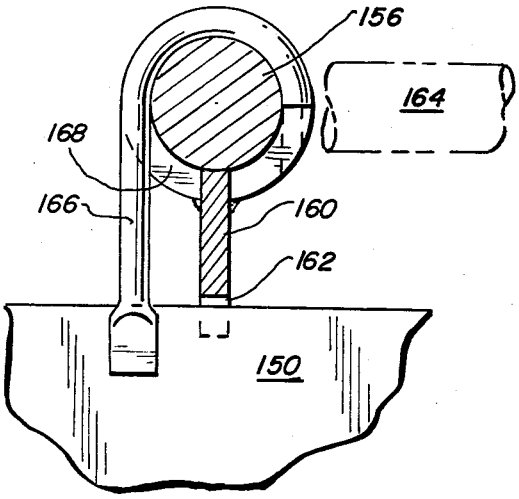
FIG. 10
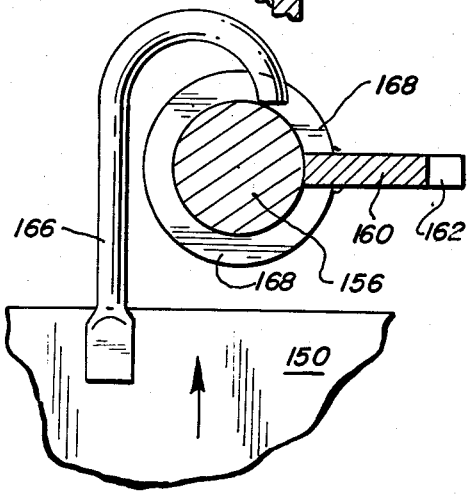
FIG. 12

FIG. 13
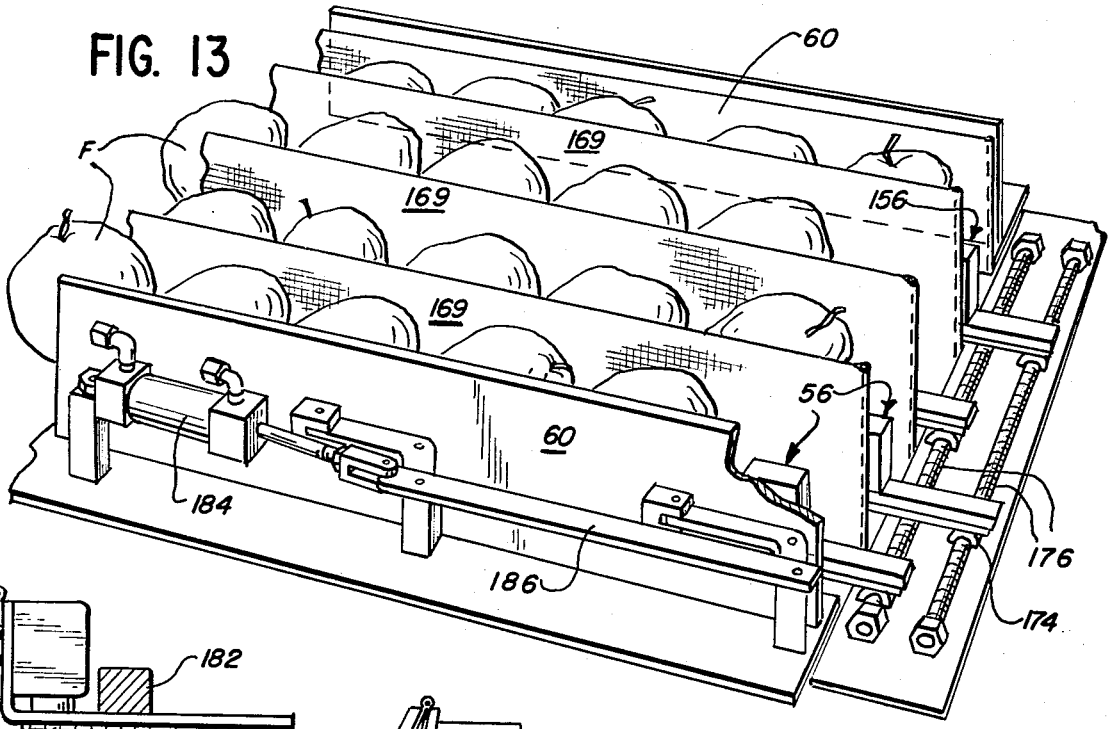
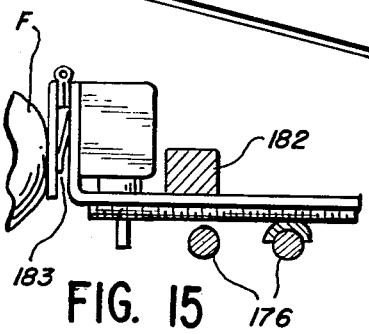
FIG. 15
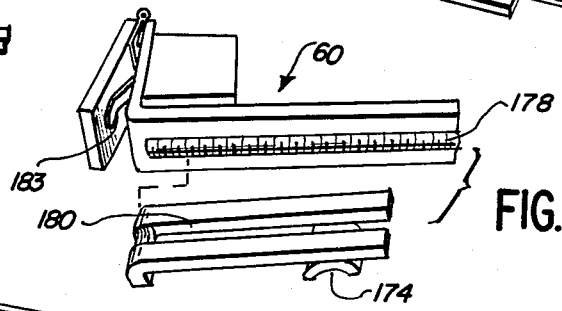
FIG. 16
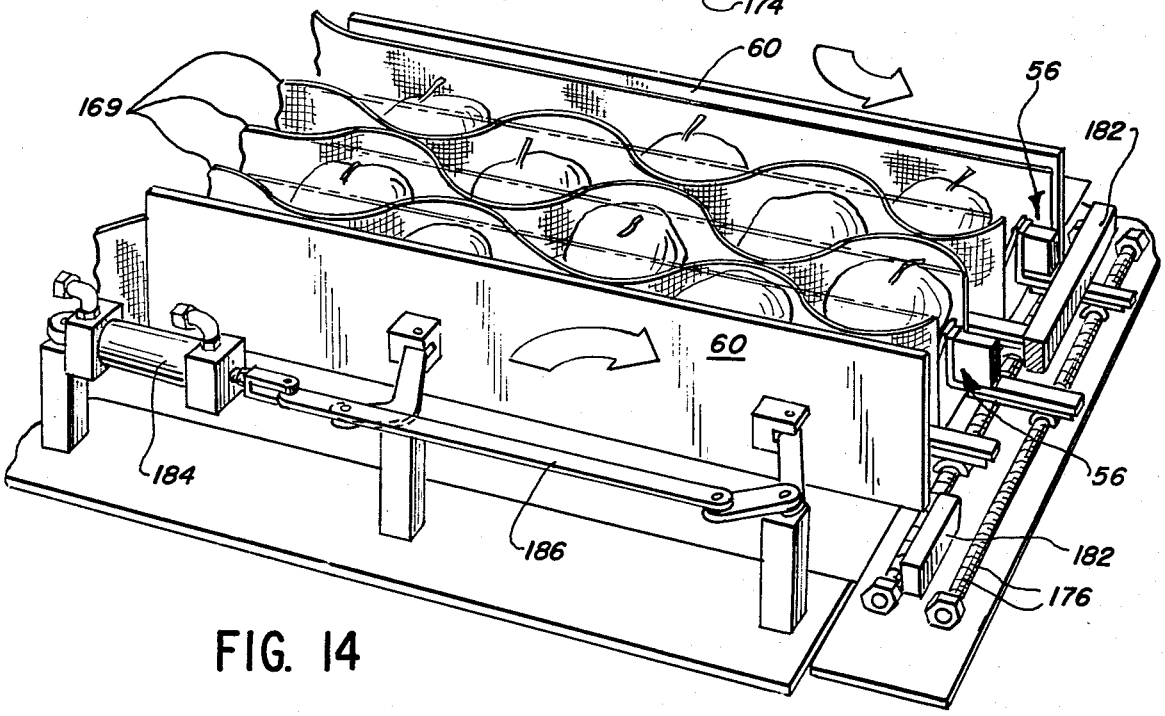
FIG. 14

FIG. 21
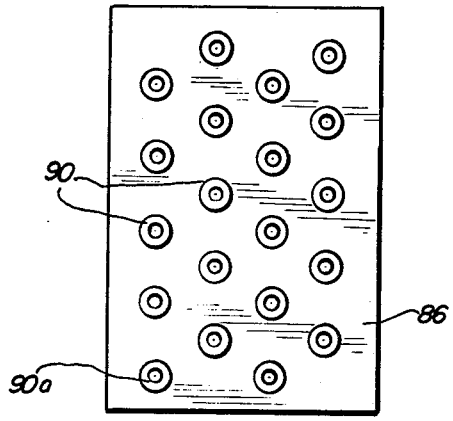
FIG. 22
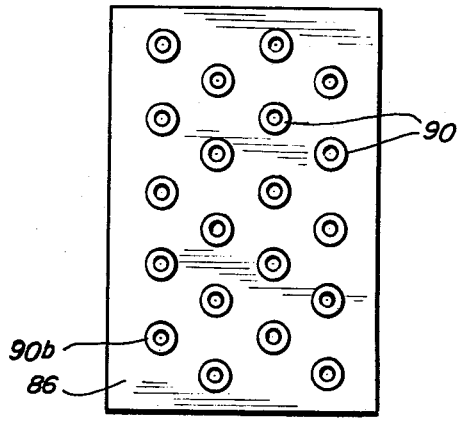
FIG. 23
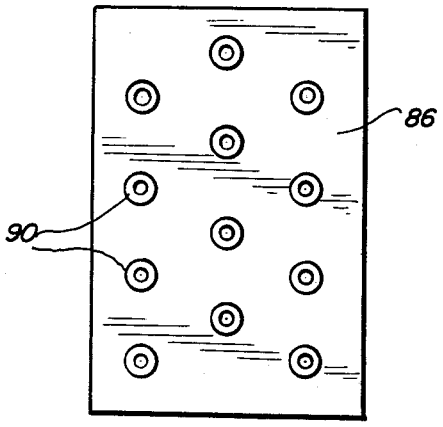
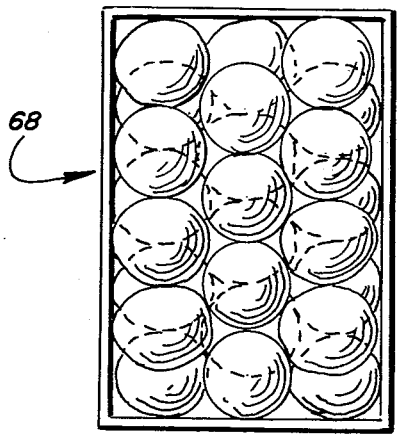
FIG. 24
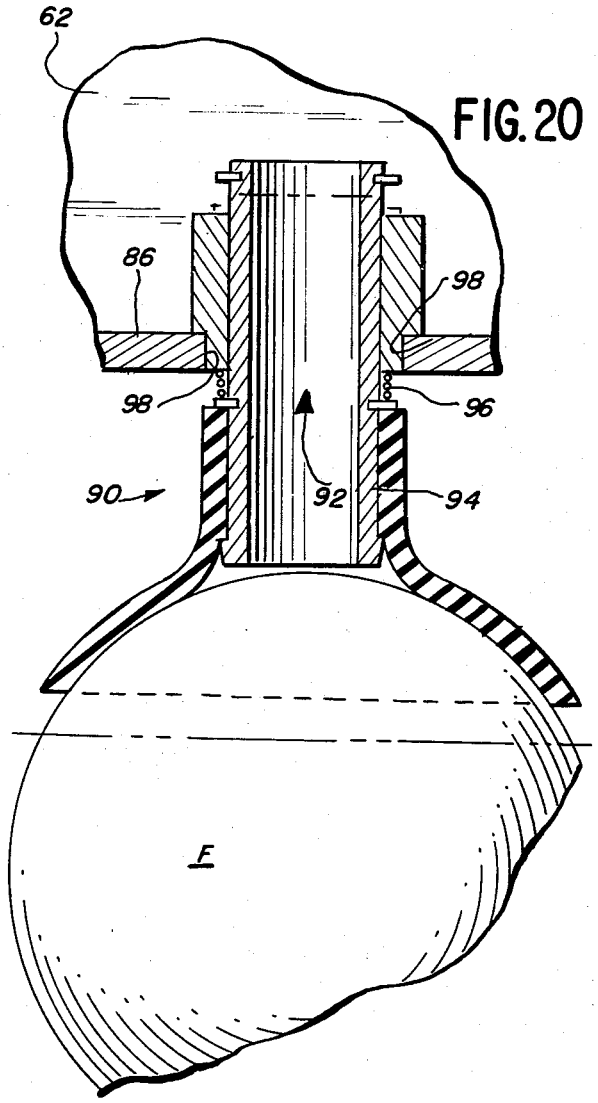
FIG. 20

MULTIPLE STATION PACKAGING MACHINE AND METHOD FOR PACKAGING

TECHNICAL FIELD

This invention relates to a machine and method for packaging articles such as fruit one layer at a time into containers.

BACKGROUND OF THE INVENTION

Numerous prior art devices have been employed for use in packaging uniform articles into containers. Some of these devices merely package articles at random into a container until a predetermined weight is reached or until the box becomes full whereupon it is sealed and transported. However, such a packaging device has the disadvantage of failing to provide a means for packaging the articles systematically and in an ordered arrangement so that maximum density packing can be achieved. This is particularly true when considering devices which pack spherically shaped articles such as fruit and the like.

Although some machines have attempted to pack articles such as fruit in layer arrangements and in nested relationship, most of these do not pack articles very quickly since only one layer is disposed into a container at any one time. With articles such as fruit, a fast packing operation would be highly advantageous since entire fruit crops often ripen over a short period and fruit must be packed quickly within a short time period in order to reduce the possibility of the fruit bruising, overripening or spoiling before it ultimately reaches the consumer.

Thus, it would be advantageous for a machine to quickly pack layers of fruit in a relationship so as to optimize the available packing room inside the container and also to provide a compact arrangement so that the articles such as fruit will be self protected by their own immobility inside the container. Not only would it be advantageous to have the fruit or other articles packed in a nested relationship by layer, but it would also be advantageous to have the fruit nested between layers so that the fruit in one layer is slightly offset from the layer immediately below and/or immediately above it. Also, the fruit should be picked up and delivered into the carton by a means which would minimize damage to the fruit or articles.

It would also be advantageous for such a machine to be accommodating to different sized articles quickly and easily so that its use would not be limited to a certain sized article or type of fruit. Not only might the number of articles per layer be different for the same sized container, but the number of layers in the container might also change depending upon the size of the article and the size of the container or box.

SUMMARY OF THE INVENTION

In accordance with the present invention, a machine for automatically packaging layers of articles into containers is provided. The machine comprises basically a multiple number of packing or loading stations. At each packing or loading station one layer of fruit is inserted and deposited into a container. After such depositing, each carton is advanced to the next station whereupon it receives another nested layer of articles. The container advances and continues to successive loading stations, receiving one layer at each loading station, until it receives all of the layers it can hold.

The machine provides means for supplying containers to a plurality of loading stations and locating the containers at each loading station to receive articles such as fruit. Means are provided for advancing the containers successively through each loading station after each container is filled with a layer of articles at each loading station. Adjacent to each loading station is a supply position where means are provided for disposing arrays of articles. The articles are disposed in a nested relationship of a predetermined number. Means are also provided for lifting the arrays of articles at the article supply positions and for depositing the arrays into the containers at each loading station. Each array of articles thus forms a layer in a container and each container receives a layer of articles at a different loading station.

Thus, the invention provides a means for packing the articles in a nested relationship within each layer. Means are also provided for lifting and depositing the arrays of articles at one loading station at a slightly offset nested relationship from the array of articles at its immediately preceding and/or immediately subsequent loading station. In this way, the articles are not only nested within the layer but are disposed in a nested relationship between layers.

In the preferred embodiment to be illustrated and described, the machine has a total of six available loading stations. Thus, if a container receives a different layer at each loading station, the machine can provide for up to six separate layers in a container. If the size of the articles dictate that less than six layers be provided in a box, one or more loading stations can be rendered inoperative so as to provide maximum flexibility of the machine for use with a large variety of different sized articles.

If the machine is set up to pack five layers of articles into a container, it will be set up to deposit one layer at each of five loading stations, but each layer will be dposited into a different one of five boxes. Each box then moves successively through each loading station one at a time and receives a different layer at that loading station. Thus, even though a box only receives one layer of articles for each machine cycle, for purposes of description, the overall productivity of the machine is one filled box for each machine cycle during normal operation of the machine. This is a great advantage over the prior art devices which provide for loading only one layer of articles into a container for each machine cycle. Thus, the invention provides a way for packing articles into containers efficiently, quickly, and in a relationship so as to minimize the movement therein after the articles are deposited and packed into the containers.

While the preferred embodiment of the invention to be illustrated and described packages fruit, and more particularly apples, it is to be understood that any one of a large variety of articles, as will become apparent to those skilled in the art, can be packed with the illustrated embodiment of the instant invention. Thus, fruit articles are used for purposes of illustration, and it is not intended to limit the instant invention to fruit articles.

BRIEF DESCRIPTION OF THE DRAWINGS

An embodiment of the invention will now be seen by referring to the attached drawings, in which:

FIG. 5 is a perspective view of part of the trough lifting assembly and an associated guide rod;

FIG. 6 is a perspective view showing a pair of container stop mechanisms in the upright position;

FIG.7 is a perspective view showing part of the trough assembly of FIG. 5 and part of the container stop mechanism;

FIG. 8 is a perspective view of one of the fruit conveyor means and fruit separator panels and panel retaining means shown in an adjustable position;

FIG. 9 is a front view of part of the separator panel retaining means in closer detail shown in its retaining position;

FIG. 10 is a cross sectional side view of the separator panel retaining means of FIG. 9;

FIG. 11 is a front view of part of the separator panel retaining means shown in the adjustable or non-retaining position;

FIG. 12 is a cross sectional side view of a separator panel retaining means in the adjustable position;

FIG. 13 is a perspective view showing the fruit conveyor side panels and an array of fruit disposed at a fruit supply station being held by the feed stop mechanisms but before being nested;

FIG. 14 is a perspective view similar to that of FIG. 13, except with the side panels shown after having nested the fruit;

FIG. 15 is a side view showing in greater detail one of the fruit feed stop mechanisms;

FIG. 16 also shows a fruit feed stop mechanism, but being shown partially disassembled for illustrative purposes;

FIG. 20 is a cross sectional view showing a holder mechanism or cup for one fruit article;

FIG. 21 is a bottom view of a fruit platen housing showing the fruit holder mechanisms in a particular first arrangement;

FIG. 22 is a view similar to that of FIG. 21 but with the fruit holder mechanisms in an offset arrangement from that in FIG. 21 to facilitate nesting between layers;

FIG. 23 is a view of another arrangement for holders on the bottom of a fruit platen but for larger size fruit than that shown in FIGS. 21 and 22;

FIG. 24 shows one form of a nesting relationship between layers for a fruit such as grapefruit with the view taken from the top of a container.

DETAILED DESCRIPTION OF THE PREFERRED EMBODIMENT

Figure 1:
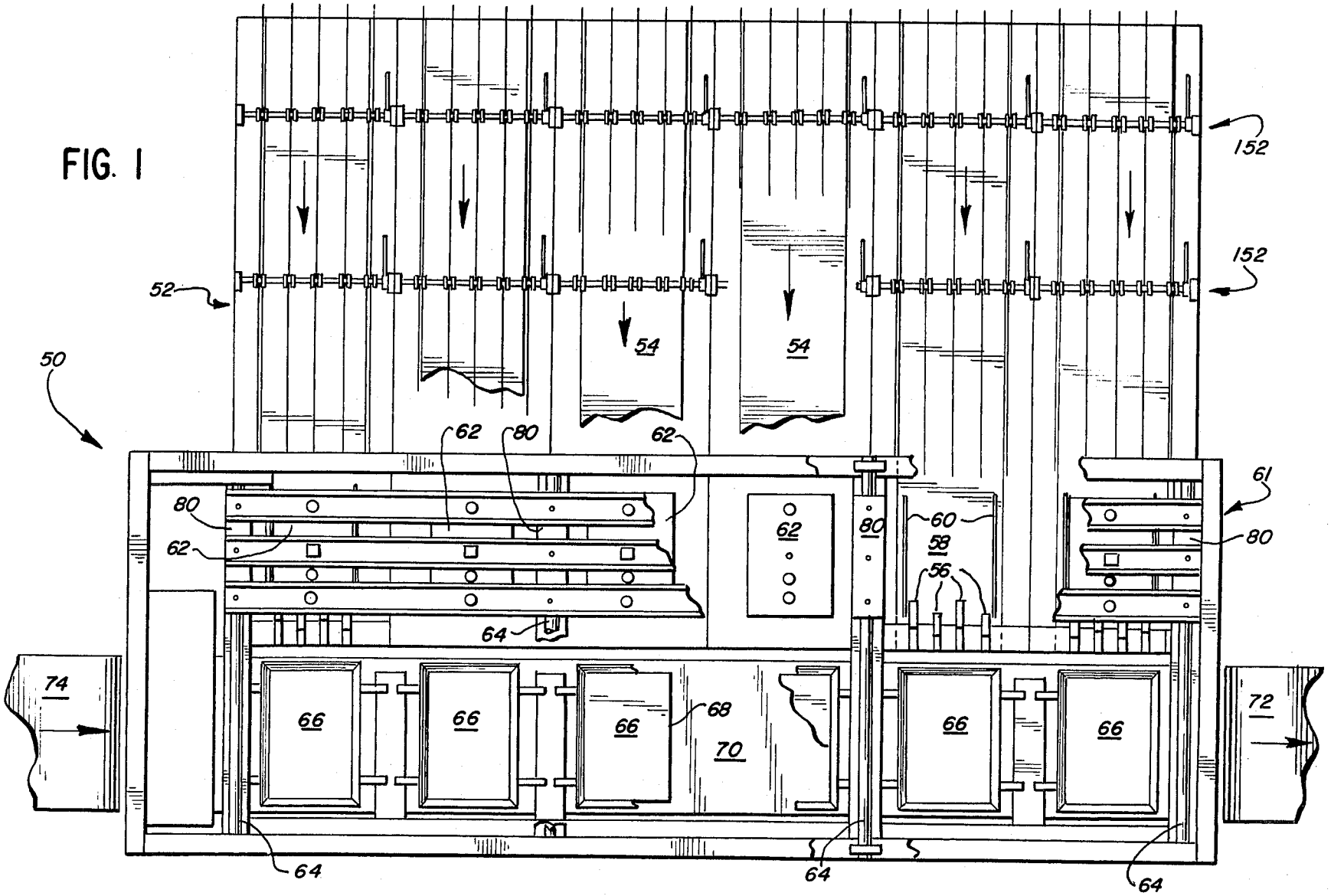
FIG. 1 is an overhead plan view of the machine shown with sections partially broken away for more ease of illustration.

Before describing the apparatus illustrating the invention in any substantial detail, it is felt that it would be desirable to describe the series of steps that occur in the operation of the novel packaging machine in conjunction with the general description of the main components of the machine. It is hoped that this will facilitate a better understanding with greater ease, of the more specific mechanisms of the machine which will be described subsequently. It will also be understood that certain operations of the machine occur simultaneously.

Returning now to FIG. 1, a packaging machine 50 having fruit loading conveyor assembly 52 comprising 6 fruit conveyors 54. When the fruit conveyor assembly is energized, the fruit advances downward in the FIGURE until it reaches the fruit feed stop mechanisms 56 shown in a staggered relationship on each conveyor. The fruit is now in un-nested rows in fruit supply positions 58. When all of the fruit feed stop mechanisms 56 sense the presence of fruit, the fruit conveyors 54 stop and the fruit side plates 60 are moved both toward each other and towards the direction of the fruit feed stop mechanism 56. This nests the fruit at each loading station into an arrangement which will provide for maximum packing density for each layer.

When the fruit is nested and ready to be packed, a fruit platen assembly 61, upon which fruit platen housings 62 are mounted, facilitate the lifting of fruit from the fruit supply stations 58 by raising the fruit vertically upward. When they are raised a sufficient height above the fruit supply station 58, the entire fruit platen assembly 61 is moved horizontally, in the downward direction of FIG. 1 along fruit platen assembly horizontal guide bars 64. When it reaches a position over loading stations 66, where separate cartons or boxes 68 are located, the fruit platen housing 62 moves vertically downward to deposit a layer of fruit into each box or carton 68. Since the cartons are loaded into the machine 50 from the left as shown in FIG. 1, each carton 68 at a particular loading station 66 will have one more layer of fruit than the carton immediately preceding it on the carton loading conveyor 70.

After the fruit is deposited into the respective cartons 68, the fruit platen housings 62 are lifted vertically upward and upon reaching an upper maximum vertical position, the entire fruit platen assembly 61 moves along fruit platen assembly horizontal guide bars 64 to return to a position directly over fruit loading stations 58.

Generally speaking, for purposes of description, movement of the fruit platen housings from the extreme lower position directly over the supply positions 58 to an extreme upward vertical position, along with movement of the entire fruit platen assembly 61 along the fruit platen assembly horizontal guide bar 64 to a position over the fruit loading station 66 and movement of the fruit platen housing 62 vertically downward to deposit the fruit in the cartons 68, and return of the fruit platen housings 62 vertically upward, return of the fruit platen assembly 61 horizontally to a position over the loading stations 58, and downward vertical movement of the fruit platen housing 62 to a position directly over the fruit supply station 58, comprises one complete machine cycle. Of course, even though the machine cycle has been described with reference to the movement of fruit platen housing 62 and fruit platen assembly 61, it is to be understood that other operations are occurring simultaneously, namely delivery of fruit by fruit conveyors 54 to loading positions 58 and advancing of cartons 68 along respective loading positions 66. Also, as will become apparent, filled cartons are advanced off of the carton loading conveyor 70 onto filled carton conveyor 72 and empty cartons 68 are supplied by empty carton conveyor 74.

A more detailed description of the parts of the machine will now follow.

FRUIT PLATEN ASSEMBLY

Figure 2:
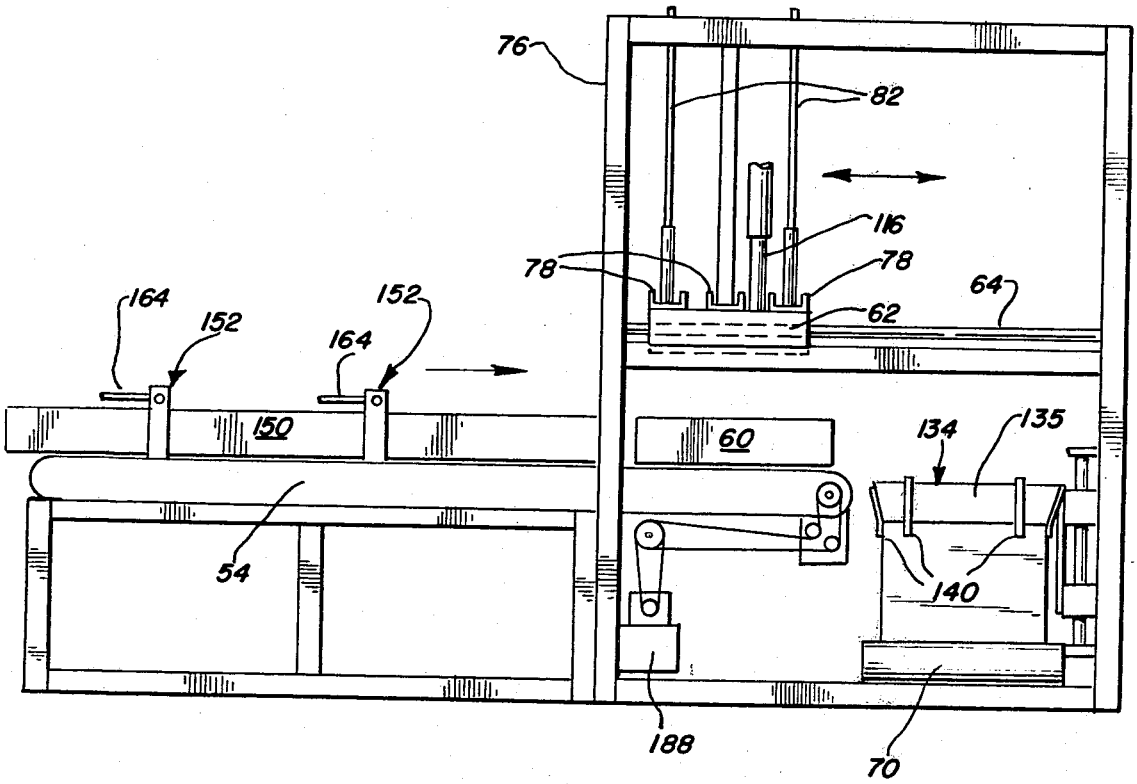
FIG. 2 is a side elevational view of the machine showing one fruit conveyor, one supply position, one fruit platen housing, and one loading station.
Figure 3:
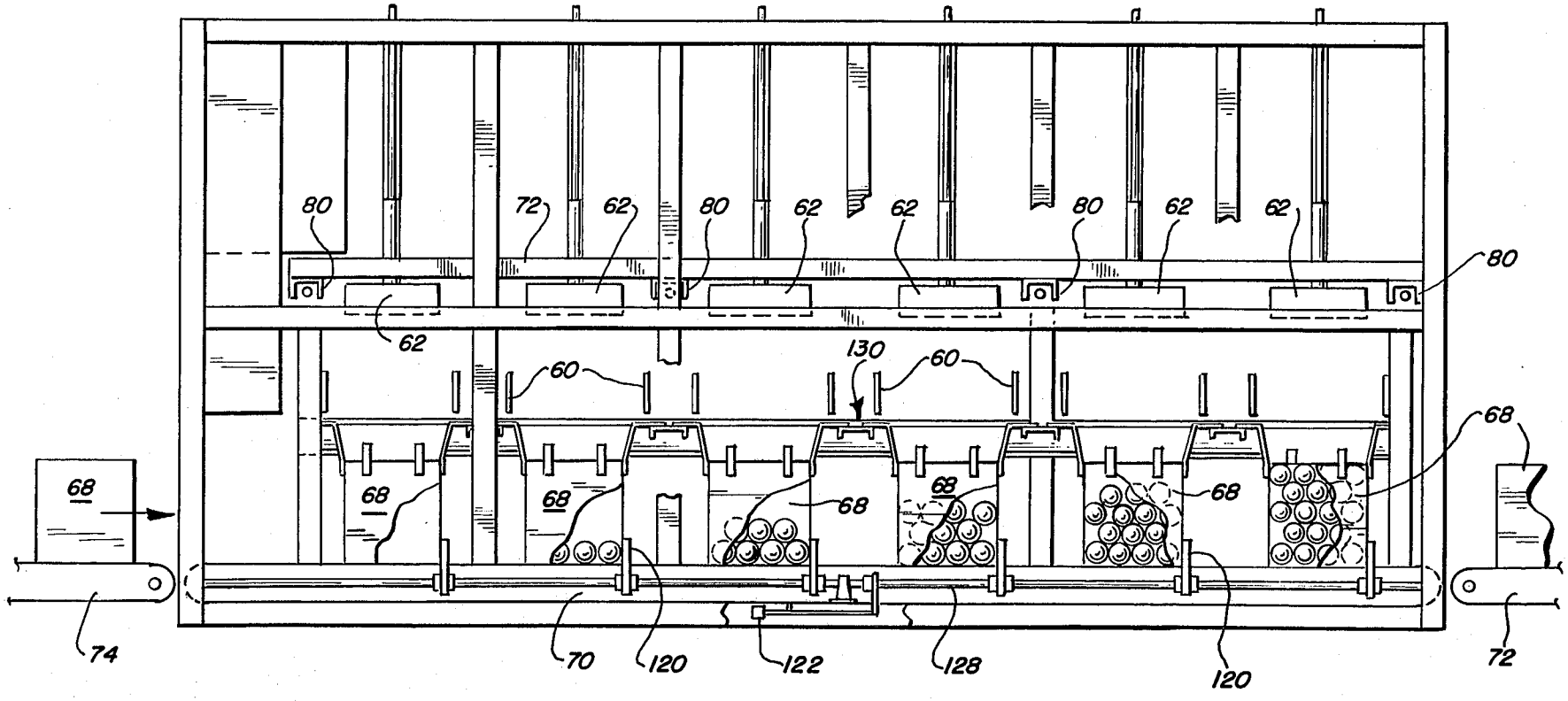
FIG. 3 is a front elevational view of the machine shown with sections partially broken away for ease of illustration and also showing boxes positioned just prior to having a layer of fruit deposited at the loading station at which it is located.

Referring now to FIGS. 1 through 4, the fruit platen assembly 61 will now be described in greater detail. The fruit platen assembly 61 occupies an upward portion of the machine frame 76 as best shown in FIG. 2. The fruit platen assembly 61 is designed to move all the fruit platen housings 62 simultaneously whenever fruit is vertically picked up at the fruit supply stations 58, horizontally moved between fruit supply stations 58 and fruit loading stations 66 and vertically moved at fruit loading stations 66. This control is facilitated using electrical circuity as will be described further below. This following discussion is merely directed to the mechanical aspects of the fruit platen assembly 61.

Figure 4:
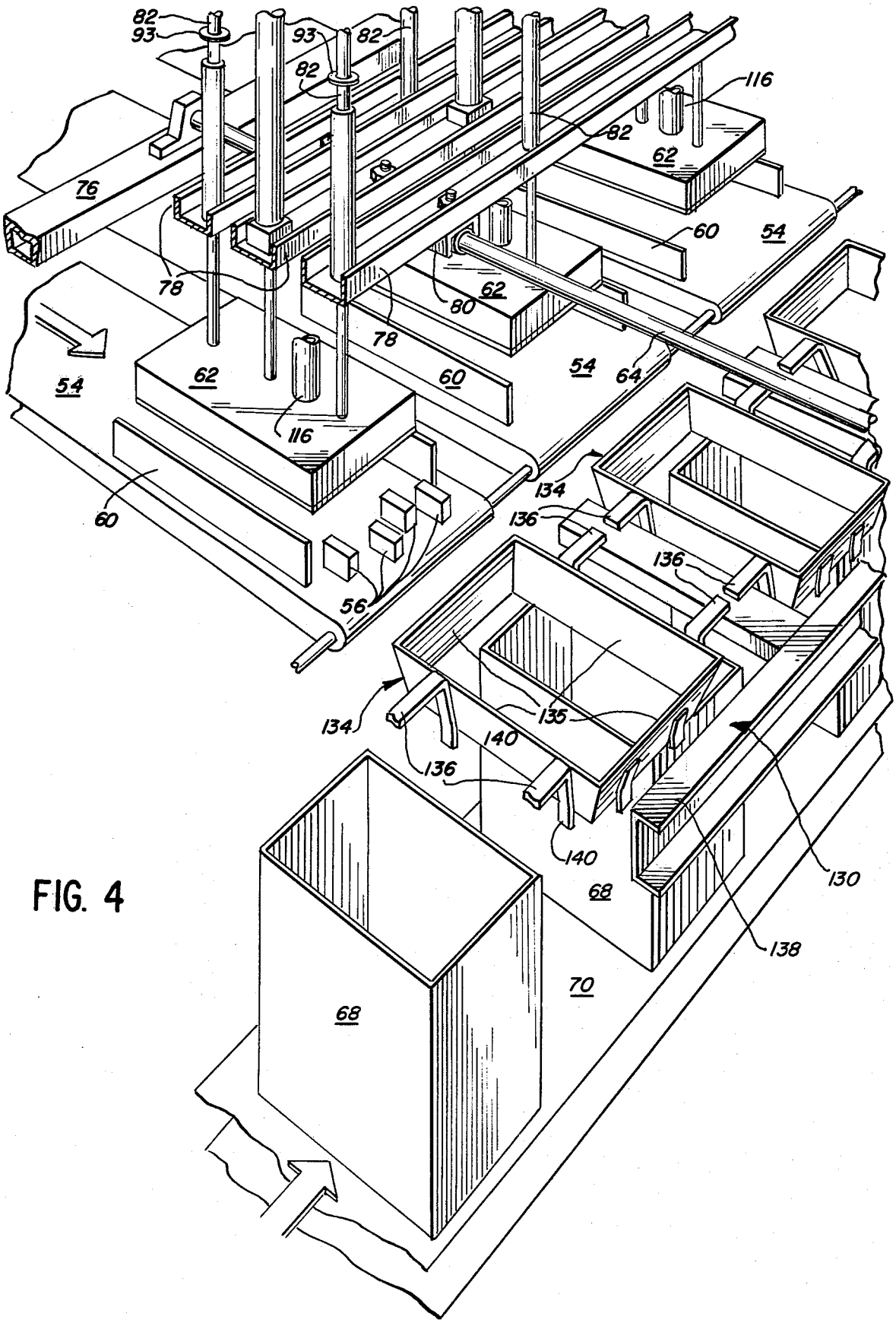
FIG. 4 is a perspective view of part of the machine showing the containers being moved between loading stations.

The fruit platen assembly 61 is comprised generally of three U-shaped channel rails 78 which extend the full length of the machine 50 as best seen in FIG. 1. These channels 78 are supported by 4 fruit platen assembly channel supports 80 to which they are suitably fastened. The supports 80 guide the fruit platen assembly 61 along the four fruit platen assembly horizontal guide bars 64. Carriage movement means are associated therewith for horizontally moving the fruit platen assembly 61 along these horizontal guide bars 64 between the fruit supply stations 58 over the fruit conveyor vicinity and the fruit loading stations 66 over the carton loading conveyor 70. The fruit platen assembly horizontal guide bars 64, as seen in FIG. 4 are suitably fastened to the upper region of the machine frame 76. Means are provided for allowing the fruit platen assembly 61 to transverse in the horizontal direction only when the fruit platen housings 62 are in the extreme upper vertical position, so that the fruit platen housings 62, whether carrying fruit or not, will not collide or interfere with mechanisms to dispose, arrange and nest the fruit at fruit supply stations 58 or with the trough assembly associated with the cartons at the fruit loading stations 66.

When the fruit platen assembly 61 is either directly over the fruit supply stations 58 or fruit loading stations 66, the fruit platen housings 62 can be controlled to move vertically upward and downward. To facilitate this, two fruit platen vertical guide bars 82 are fastened at their lower end to each of the fruit platen housings 62 and are adapted to slide within suitable sleeves 84 which are fixed at their lower end to the fruit platen assembly 61. A fruit platen vertical piston 85 controls the vertical movement of the fruit platen housings 62, and one of these is provided for each fruit platen housing 62.

At this point, it is worth noting that in certain arrangements with certain sized articles or fruit to be loaded, not all of the fruit platen housings 60 will move vertically if the containers or cartons 68 have the capacity to hold only five or fewer layers of articles. In this case, in the preferred embodiment, control means are provided for disabling fruit platen assemblies 61 so that they will not be used for lifting and depositing fruit. In the illustrated embodiment, when only five layers of fruit are loaded, the rightmost fruit platen housing 62 (as shown in FIG. 1) will be disabled. If only four layers of fruit are to be loaded into particular cartons, then the second rightmost fruit platen housing 62 will also be disabled. The same applies with respect to the third rightmost fruit platen housing 62.

Returning now to the fruit platen housings 62, it will be seen from FIGS. 22 and 23 that a bottom plate 86 is provided with apertures 88 which are arranged in a predetermined pattern. Each of these apertures 88 receive a cup assembly 90 which facilitates, in conjunction with a vacuum pump assembly which will later be described, the lifting of fruit from the fruit supply positions 58. When the fruit platen housing 62 is in a vacuum condition, air is sucked into the housing 62 generally in the direction of the arrow along passage 92 as shown in FIG. 20. When positioned over the fruit at a supply position 58, this facilitates retaining the fruit in the cups 90 by the differential pressure acting on the fruit. The fruit holding action results from the venturi effect created by the air flow around the fruit and through the cups 90 into the fruit platen vacuum housing 62, which results in a positive differential pressure acting against the fruit to hold them in their respective cups while the vacuum housing 62 is being vertically raised above the fruit supply position 58, horizontally moved to the fruit loading station 66, and moved vertically downward into the containers 68. At that time, as will later be described, the flow of air in passage 92 is reversed by way of a valve control mechanism which will facilitate in positively releasing the fruit from the cups by blowing air through the fruit platen housing to create a pressure condition in the fruit platen housing. It should be understood that the term vacuum has been used for purposes of description, and refers to the situation where air flows upward through the cups 90, or where a subatmospheric air pressure condition exists in a vacuum housing 62.

The fruit platen housings 62 are lowered to different levels in the containers or cartons 68 as determined by how many layers of fruit have been previously deposited into the carton or container. This is facilitated by setting a vertically downward fruit platen housing stop mechanism or collar 93 associated with the fruit platen vertical guide bars 82 and fruit platen vertical piston 84. The stop positions can of course be adjusted, when desired, to load different sized fruit.

The bottom plates 86 of the fruit platen housings 62 are capable of being removed and replaced depending upon the different sized fruit to be loaded into containers. FIG. 21 shows a spacing of cups 90 in a closer packing arrangement for apples where as FIG. 23 shows a more distant arrangement of cups 90 for grapefruit, for example. Also, to facilitate nesting between layers, where one layer will be slightly offset from its immediately preceding and immediately subsequent layer, the arrangement of cups 90 on the lower plate 86 of the fruit platen housing 62 will be slightly different as can be seen from FIGS. 21 and 22. As can be seen, in FIG. 21, the cup 90A in the lower left hand corner is in a different position than the cup 90B in the lower left hand corner in FIG. 22. This will result in the packing arrangement as illustrated in FIG. 24.

For illustrative purposes, FIG. 20 shows the construction of a cup assembly 90 secured to the plate 86 of a fruit platen vacuum housing 62. These cups 90 are mounted on a tubular member 94 and are spring biased by spring 96 against a depending flange portion 98. As can be seen in FIG. 20, when a cup 90 is lowered to receive a piece fruit F on the fruit supply station, the cup 90 is moved upwardly against the action of the spring 96. In this way, the cups 90 are designed to be moved slightly so as to minimize any bruising of fruit when they are picked up, and also facilitates packing varying sizes of fruit, within a given range of tolerance.

VACUUM MANIFOLD ASSEMBLY

Figure 17:
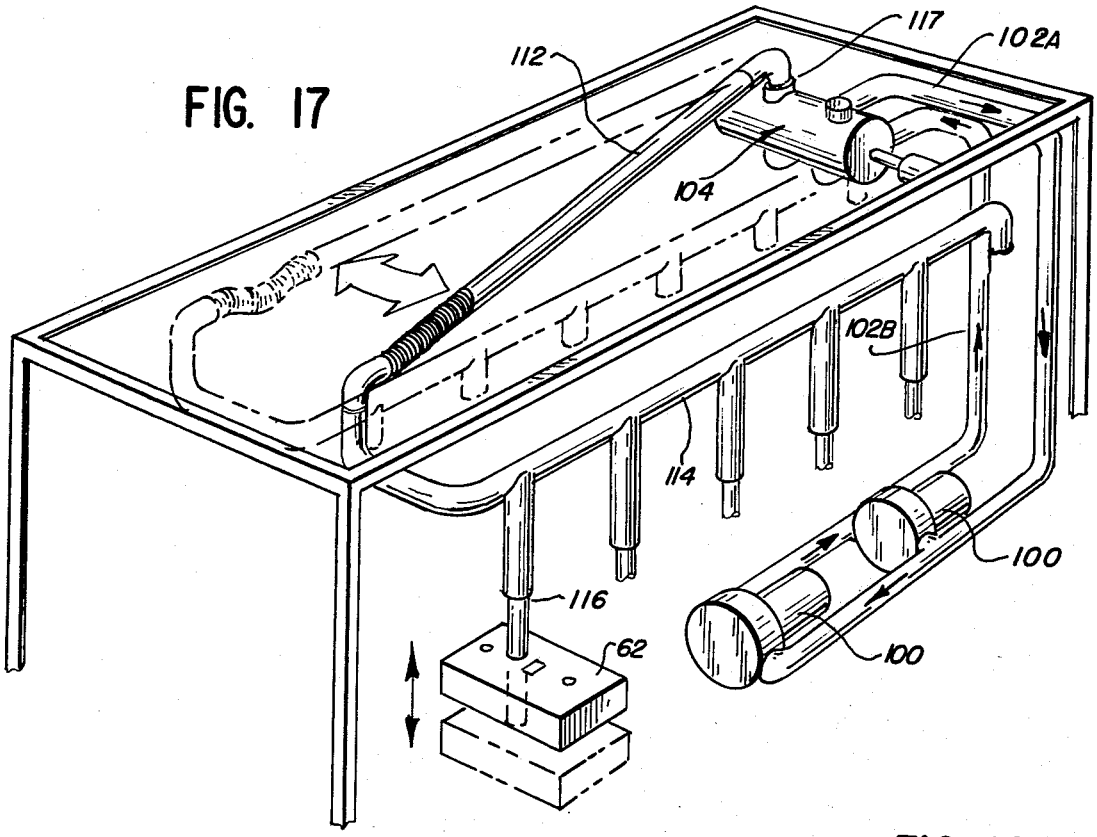
FIG. 17 is a perspective view showing the mechanism for supplying a vacuum or pressure condition to the vaccum housing platen assemblies.
Figure 18:
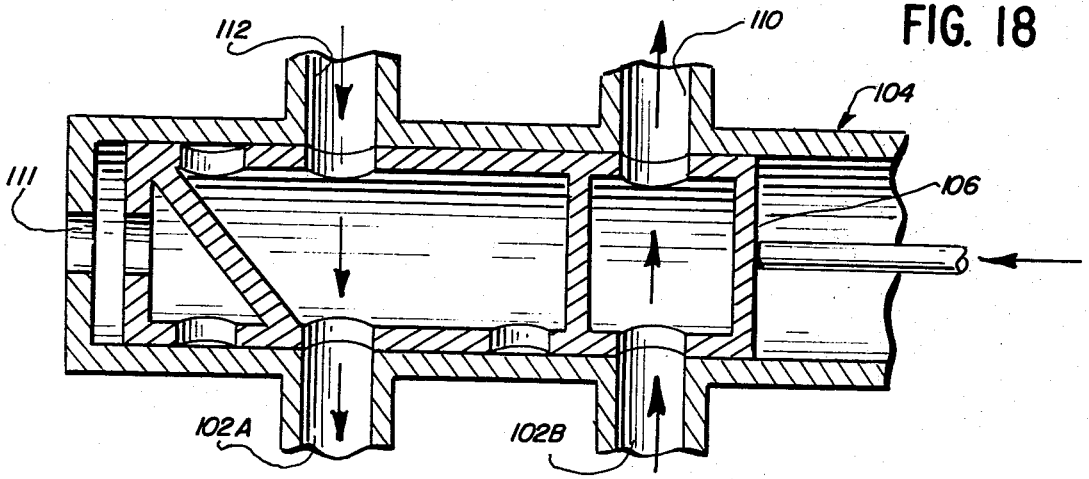
FIGS. 18 and 19 are views showing two positions of the valve mechanism for controlling the flow of air to the vacuum housing platen assembly manifold, FIG. 18 showing a pressure condition and FIG. 19 showing a vacuum condition.
Figure 19:
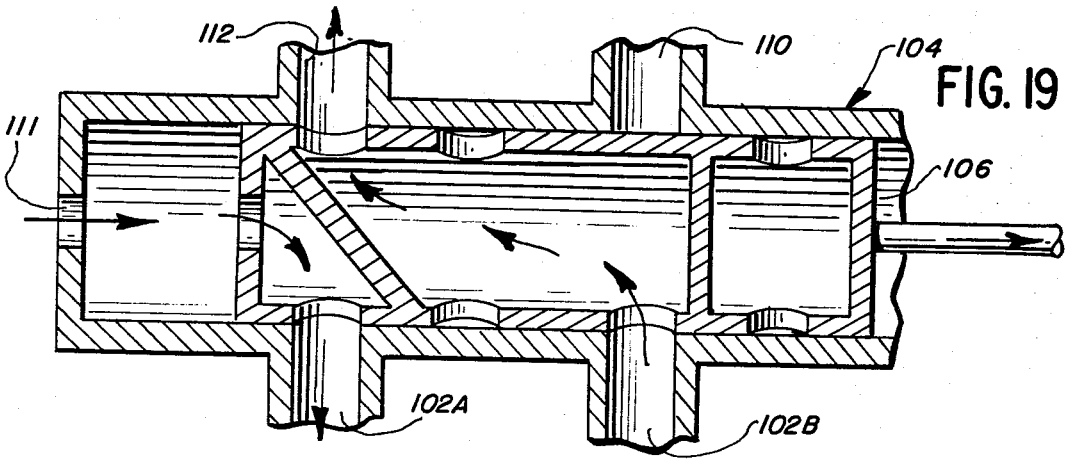

Located on the frame structure of the machine shown in FIG. 17 are two vacuum pumps 100 arranged in a parallel relationship. Therefore the air flow in line 102A is always in the direction shown by the arrow and the flow of air in line 102B is always in the direction shown by the arrow. A piston operated valve 104 is shown in its two operative positions in FIGS. 18 and 19. The position of piston 106 within the valve 104 is controlled by the electrical circuitry as will be later described. Suffice it to say for now that outlets 110 and 111 are always vented to atmosphere whereas line 112 is either in communication with 102A to create a vacuum condition, or 102B to create a pressure condition, depending upon the position of the piston 106 within the valve 104. When loading or carrying the fruit, line 112 will be in communication with the vacuum 102A as shown in FIG. 18, whereas when the fruit platen assembly 61 is depositing the fruit or returning to the fruit supply positions 58, the line 112 is in communication with 102B, creating a pressure condition wherein air will blow out of the cups 90.

The connection of line 112 via flexible tubing to a hose manifold 114 is shown in FIG. 17. A hose arrangement 116 communicates between the hose manifold 114 and each fruit platen housing 62, and is comprised of two reciprocating concentric hoses. Pipe 112, generally at the valve 104, has a flexible connection to enable the long end of the pipe to pivot generally about its mounting point 117 on valve 104 as shown in FIG. 17. The manifold 114 is suitably mounted to the fruit platen assembly 61 and moves horizontally with it.

CARTON CONVEYOR ASSEMBLY

As mentioned previously, cartons are advanced from one position to the next loading station 58 or outwardly onto the filled carton conveyor 72 at the advancement rate of one position for each machine cycle. Empty cartons are provided by empty carton conveyor 74 and filled cartons are removed by filled carton conveyor 72. The advancement and guiding of the cartons 68 along the carton loading conveyor 70 will now be described in greater detail. The carton loading conveyor 70 is controlled by means of electrical circuitry which will be described below. However, certain mechanical aspects of the means to control the advancement of cartons will now be described.

Referring now to FIG. 6, carton loading conveyor 70 is shown advancing a carton 68. The carton 68 will advance until it hits a pair of carton stop mechanisms 120, which are shown in the up position in the path of the carton 68. Switches are provided in the carton stop mechanisms 120 to sense the presence of a carton 68 thereagainst. When a carton is sensed at each of the loading stations 66 all of the carton sensing switches will be closed, and the carton conveyor 70 will stop. At that time, electrical control circuitry will actuate the piston 122 so as to make its cylinder rod 124 be fully received inside the cylinder. This in turn will cause the carton stop mechanisms 120 to recede downward out of the way of the path of cartons 68 since linkage assembly 126 will cause carton feed stop rods 128 to rotate on their respective axes.

When the carton loading conveyor 70 again advances the cartons after they have been loaded with a layer of fruit at loading stations, the carton stop mechanisms 120 will come up as soon as the previously loaded carton 68 moves from that particular loading station. These carton stop mechanisms 120 will then be in position ready for the next box or carton 68 to sense its presence and to turn off the carton loading conveyor 70. These carton stop mechanisms 120 not only sense the position of a carton 68 at a particular loading station 66 but help align the box at that particular loading station.

In order to more fully align the cartons 68 at particular loading station 66, a trough assembly 130 is provided, which is best shown when looking at FIGS. 4, 5 and 7. The trough assembly 130 is mounted to the machine frame via vertical trough assembly guide bars 132 along which they reciprocate. The trough assembly 130 moves only vertically upward and downward. It is in the upper position when the cartons 68 can be advanced by carton loading conveyor 70, since control circuitry is provided for advancing carton loading conveyor 70 only when the trough assembly 130 is in the extreme upper vertical position.

The trough assembly 130 provides six individual troughs 134 which are each fixedly attached via four straps 136 to the frame 138 of the trough assembly. The troughs 134 have four downwardly depending sides 135 which act as a funnel or guide means for the fruit platen housings 62 as it lowers fruit into the box. At the lower edges of troughs 134, eight box location means 140 are provided to more fully align the box in its respective fruit loading position 66 when the trough frame 138 moves downward as controlled by the control of fluid to valve 142. If the container 68 is provided with top flaps, these box location means 140 help assure that these top flaps of the container are not in the path of the fruit platen housings 62 as they lower fruit into the boxes. Vertical movement of trough assembly 130 is facilitated by a number of vertical control pistons 142 arranged around the perimeter of a trough assembly 130. These of course are controlled by the electrical circuitry which will be described below.

FRUIT LOADING CONVEYOR ASSEMBLY

Referring now particularly to FIGS. 8 through 16, the fruit conveyor assembly and means to dispose the fruit to be picked up will now be described in greater detail.

As shown in FIG. 1, there are six fruit conveyors 54 which are provided for bringing the fruit in row arrangement into fruit loading stations 58. Of course, if the size of the fruit and the container dictate less than six layers of fruit being deposited in the container, some of the fruit conveyors 54 will be rendered inoperative along with their respective fruit platen housings 62. As shown in FIG. 8, each fruit conveyor 54 has disposed thereabove separator or alignment plates 150 which act to dispose and align the incoming fruit into rows. The machine as shown in FIG. 8 is set up to dispose the fruit into four separate rows along the conveyor 54. However, as will be described, the position and spacing of the plates 150 can be adjusted since the retaining means to hold the separator plates 150 in position can be released so as to facilitate manual movement of the plates 150 to new positions depending on the size of fruit which is to be loaded.

Several fruit separator plate retaining means 152 are disposed along the length of each fruit conveyor 54 as shown in FIG. 1. FIG. 8 shows one such retaining means 152 which will now be described in greater detail. Each such retaining means comprises a pair of upwardly extending posts 154 disposed on opposited sides of the conveyor. These posts receive a retaining rod 156 which is allowed to rotate in apertures in the posts. Fixedly attached along the length of the rod 156 are retaining collars 158 which have set screws to fixedly, but removably, attach them to the bar 156. The retaining collars 158 have a radially extending tab 160 with a notch 162 in its center which is adapted to receive the upward edge of a separator plate 150 as shown in FIGS. 8, 9 and 10. As seen in FIG. 8, the bar 156 is adapted to rotate between to positions by a fruit retaining means lever 164. With the fruit retaining means lever 164 in the upright vertical position, and retaining collars 158 are positioned so that their radially extending tabs 160 are free and clear of the separator plates 150 so that manual adjustment of these plates 150 can be facilitated. When the separator plates 150 are in their desired position, the fruit retaining lever 164 is moved 90° to a horizontal dotted line position as shown in FIG. 8 whereupon the notches 162 and the tabs 160 receive the top edge of the separator plates 150 to retain them against movement.

Retaining collars 158 can be easily provided along the entire length of the rod 156 at predetermined positions so that the plates 150, when being positionably adjusted, can merely be moved directly underneath a different retaining collar 158 if that position is desired. This will facilitate fairly quick changing of the positions of the separator plates 150 merely by actuating the fruit retaining lever 164 and moving the plate 150 to a new position, without the need to reposition retaining collars 158 along the rod 156.

Each separator plate 150 also has an upwardly extending J hook 166 which is adapted to half way encircle the diameter of the rod 156 in the slot 168 of the retaining collar member 158. In this way, the separator plates 150 are elevated above the fruit conveyor 54 so as to not inhibit the movement of fruit conveyor 54.

As the fruit is advanced via the fruit conveyor 54 towards the fruit supply station 58, they will maintain their row arrangements due to the existence of flexible, spring tensioned tapes 169 and by side panels 60 as shown in FIG. 13. Each leading fruit in the row will be pushed against a feed stop mechanism 56 shown in more detail in FIGS. 15 and 16. The feed stop mechanisms 56 are arranged in a staggered row relationship so that the leading fruit F in each row will stop at a position slightly different from the leading fruit F in its adjacent row. The desired staggered distance is equal to about one half of the diameter of the fruit F which is being loaded.

These feed stop mechanisms 56 have on their lower face a threaded half-cylindrical channel 174 which is adapted to engage one of two threaded bars 176. Each threaded bar 176 is fixedly attached at its end to the frame of the machine. Since the distance between these two bars 176 will not always be the same distance that the fruit rows should be staggered, the fruit stop mechanism 56 comprises two pieces which slide relative to each other as shown in FIG. 16. Its upper piece has a threaded welded semi-cylindrical bolt 178 while its lower piece has a threaded semicylindrical channel 180. In this way, virtually any staggered arrangement of the fruit rows can be achieved by either varying the relative positions of the bolt 178 in channel 180 or by varying the position of channel 174 on bolt 176.

The arrangement of channel 174 with bolt 176 also facilitates additional feed stop mechanisms to be placed and arranged at the end of the fruit supply station 58 if more or less than four rows of fruit are to comprise an array or layer of fruit. However, once all of the feed stop mechanisms are located in their desired position, they are fixedly held in place by feed stop retainer bars 182 as shown in FIGS. 14 and 15.

Located in each feed stop mechanism 56 is a microswitch 183 which acts in conjunction with electrical circuitry to sense the presence of fruit at its respective feed stop mechanism. When all of the switches in the feed mechanism 56 are actuated, all of the fruit conveyors 54 are stopped. At that time, control circuitry actuates piston 184 and linkage 186 to move the side panels 60 both toward each other and generally in the direction of the feed stop mechanisms 56 as shown by the large arrow in FIG. 14. Thus, not only are the rows of fruit nested with each other, but by providing side panel movement generally in the direction of the feed stop mechanism, it assures that the fruit will maintain its compact relationship up against the feed stop mechanisms. Otherwise the leading fruit might drift away from their positions in front of the feed stops. FIG. 13 shows the fruit before it is nested with the side panels 60 in their extreme outer positions, and FIG. 14 shows the side panels in their inward and forward positions with the fruit in a nested relationship. FIG. 14 shows the flexible nesting tapes 169 conforming to the nested fruit. Control of this piston 184 is through electrical circuitry which will be discussed below.

FIG. 2 shows a fruit conveyor motor 188 which controls the movement of the fruit conveyors 154 through linkage and belts as shown. The control of this motor along with the other mechanisms, is via electrical circuitry which will be described below. A suitable motor for the carton conveyors is provided, and its power is likewise controlled by the electrical circuitry which will be described below.

ELECTRICAL CONTROL CIRCUITRY

Figure 25A:
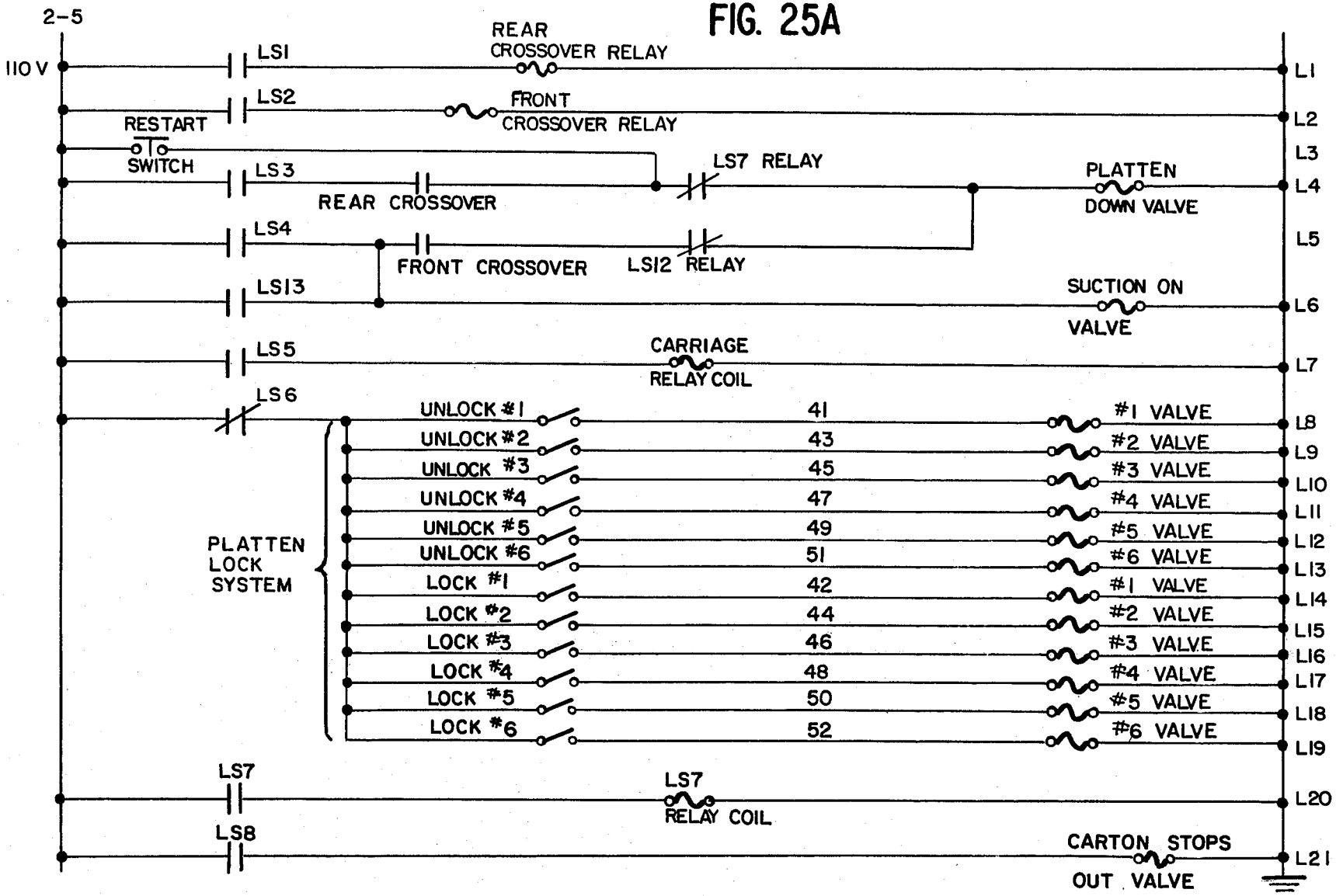
FIGS. 25A, B and C illustrate the electrical control circuitry of the machine illustrated in FIGS. 1–24.

Referring now to FIGS. 25A, B and C, the electrical control circuitry of the packaging machine will now be described in greater detail. The electrical control circuitry comprises numerous limit switches which sense movement of various parts of the machine, and relays which are energized in response to certain conditions. For ease of convenience, certain circuit components, i.e., limit switches and relays, will be referred to by their location by a line number. Line numbers appear at the extreme right of each of the FIGS. 25A, B and C.

Referring now to line numbers L1 and L2 in FIG. 25A, rear cross over relay and front cross latching relay are really one relay which control the operations of certain other components based upon whether the fruit platen assembly 61 is disposed at the rear of the machine, i.e., over the fruit conveyor and pick-up location, or at the front of the machine, i.e., over the carton conveyor. LS1 and LS2, respectively, are momentary contact switches which are closed by a cam just before the fruit platen assembly 60 reaches the extreme rear and extreme front positions, respectively. Once the cross over relay is switched by one of the two momentaries LS1 and LS2, it is latched in that position until it is energized and reversed by the other of LS1 and LS2.

LS3 (line 4) is a momentary switch located so that its contacts close when the fruit platen assembly 6 is at the extreme rear position over the fruit conveyors. Thus, if the fruit platen assembly is in such a position, and the rear cross over has been latched in by the closing of momentary switch LS1 in line 1, the platen down valve in line 4 is energized so that the fruit platen housings move downward towards fruit at the supply positions.

At this time the suction on valve (line 6) is energized if the fruit nesting side plates 60 are at their extreme outward position free and clear from beneath the fruit platens. When the fruit platens reaches its full extreme lower vertical position over the fruit stations, limit switch LS9 in line 36 closes. Rear cross over contacts in line 36 are also closed due to the previous latching of cross over relay (line 2), and the platen timer in line 36 is energized. After a given amount of time, say a few seconds, to assure that the fruit is firmly held in the cups, the fruit platen up valve in line 36 is energized and the fruit platens begin their upward movement lifting the fruit from the fruit supply positions.

Looking now to line 7, limit switch LS5 is a momentary switch which closes just before the platen reaches its extreme upper vertical position. At this time the carriage relay coil (the mechanism which helps control horizontal movement of the entire fruit platen assembly 61) in line 7 is energized closing carriage relay contacts in line 33. This energizes carriage to front valve in line 32, and the fruit platen assembly 6 begins to traverse horizontally on the fruit platen assembly horizontal guide bars towards the fruit depositing or loading station above the container conveyor 70. Just before the assembly 61 reaches its extreme front position over the carton conveyor, limit switch LS2 (line 2) closes and the cross over relay is latched in reverse (line 2). When the fruit platen assembly 61 reaches the extreme front position, limit switch LS4 (line 5) closes, completing the circuit through line 5 to the platen down valve. At this time all of the individual platen housings 62 which are operative travel downward and stop at various positions. As described previously above, the fruit platen housing 62 will stop at any one of a number of various positions depending upon how many layers have been loaded into the box immediately beneath it. The position in which it stops is determined by set up of the machine by placement of mechanical stop mechanisms 93 (FIG. 4) on the guide rod 82 in relation to the piston 84.

When the first fruit platen housing 62, i.e., the fruit platen housing going down into the box with no layers of fruit already in it, reaches its extreme downward vertical position, limit switch LS10 in line 37 closes and the suction off valve in line 38 is energized, thereby causing the vacuum condition, which is presently in the fruit platen housings 62, to reverse to a pressure condition wherein air is forced out of the cups 90 to positively deposit the fruit into the cartons. The front cross relay in line 37 has been previously latched, and when the platen timer is energized after a predetermined period of time defined by the timer, the fruit platen up valve (line 36) is energized, which causes all of the individual fruit platen housings 62 to move vertically upward after they have deposited the fruit. Just before these fruit platen housings 62 reach the extreme upward vertical position, limit switch 5 in line 7 again closes energizing carriage relay coil in line 7. When carriage relay coil in line 7 is energized, it is latched and the carriage relay contacts in line 33 cause a circuit to be completed through line 34 energizing the carriage to rear valve in line 34. The entire fruit platen assembly 61 then begins to traverse horizontally rearward to over the fruit supply stations.

Just before the entire fruit platen assembly 61 reaches the extreme rearward position over the fruit stations, the limit LS1 in line 1 causes a rear cross over relay to be energized and latched in reverse (in the rearward position). When the entire fruit platen assembly 61 does in fact reach the extreme rear position, limit switch LS3 in line 4 closes and completes a circuit through line 4 whereupon the entire cycle is repeated for the fruit platen assembly 61 and the fruit platen housings 62, including the suction on and suction off fruit lifting cup assemblies. For purposes of description, movement of the fruit platen assembly 61 and fruit platen housing 62 through the steps just described comprise one machine cycle.

Of course, simultaneously with movement of the fruit platen assembly 61 and fruit platen housings 62 are other operations, namely carton advancement and fruit delivery, arrangement and nesting. Also associated with carton advancement is the trough lifting and lowering mechanism and assembly.

Before proceeding to discuss these operations just mentioned, it will be useful at this time to discuss the platen lock system which is the means by which one or more of the fruit platen housings 62 is rendered inoperative, which would be desired if less than 6 layers of fruit is to be deposited in a container. As mentioned, the number of layers of fruit would be dictated by the size of the fruit and the size of the boxes or containers.

Referring now to lines 8 through 19, it is seen that 12 electrical lines are provided. However, this has been drawn for purposes of illustration, since the unlock switch 1 in line 8 and the lock switch in line 14 comprise merely a single pole double throw switch, whereby only one of these two switches can be actuated at any one time. That is to say, either that particular fruit platen housing 62 is either actuatable and operative (unlocked), or rendered inoperative (locked) in the extreme upward vertical position.

When a particular fruit platen housing 62 is rendered inoperative, means are provided so that fluid is not allowed to enter the fruit platen vertical piston 85 which controls that particular fruit platen housing 62. Also, means are provided for shutting off the air from the vacuum hose manifold 114 to the fruit platen housing 62 rendered inoperative.

The facility to switch between locking and unlocking positions just described can only be done when the limit switch LS6 is closed (line 8). This limit switch 6 is illustrated closed because all fruit platen housings 62 are in the extreme upward position. Thus, one can not change the locking-unlocking state of a particular fruit platen housing 62 while one or more other fruit platen housings 62 are disposed somewhere beneath the extreme upper vertical position. This might result in an unsynchronized movement of fruit platen housings 62, which is obviously undesirable.

The container conveyor and trough assembly movement will now be described. For ease of understanding, the trough assembly operation will be described first, since one of the limit switches sensing the trough assembly movement controls whether the cartons can be advanced by the carton conveyor. Returning now to line 35, it can be seen that the trough up valve in line 35 can be energized only if the rear cross over contacts in line 35 are closed. This occurs after the fruit platen assembly 61 reaches the rearward position, and is latched by the momentary contact LS1 in line 1. Also, in order for the trough up valve in line 35 to be energized the limit switch LS5 must be closed. This occurs when the fruit platen housings just reach their upward vertical position. As soon as the aforesaid conditions are satisfied, the trough assembly moves up free and clear of the underlying cartons on the carton conveyor.

Referring now to line 20, it will be seen that relay coil LS7 would be energized when the trough lift assembly is in the extreme up position, which will close contacts LS7 in line 20. At that time, the relay contacts LS7 in both lines 22 and line 30 close. Lines 22 through 28 contain normally closed carton stop switches which are mounted into the carton stop mechanisms 120 shown in FIG. 6. As cartons engage the stops 120, the carton stop switches will open one by one. Thus, once the trough is in the extreme upward position and relay contacts LS7 are completed in line 22, the carton conveyor is energized and will continue to be energized until all 6 boxes engage the carton stop switches. When all of the cartons are in position, the circuit is broken through the carton conveyor coil of line 28 and the cartons cease movement.

A second set of carton stop switches are provided in line 30. These are normally closed and might be the other throw of the other stop switches if they are SPDT switches. Once all of the cartons cause this second set of carton stop switches in line 30 to close, the trough assembly down valve is energized in line 30 and the trough assembly then commences its downward movement. Once it reaches its position over the boxes, it will repeat its upward and downward cycle as previously described and when the conditions warrant.

Referring now to the carton stop mechanisms shown in FIG. 6, the means to control the control piston 122 will now be described. The carton stops 120 are removed from the path of the cartons when carton stops out valve in line 21 is energized. This occurs when limit switch 8 is closed. Limit switch 8 in line 21 is closed just before the trough switch reaches the extreme upward position. It indicates that the trough is up and out of the way of the boxes so that they can move. As described previously, relay coil LS7 in line 20 is energized when the trough lift does in fact reach the extreme upward position. This energizes line 28 and causes the carton conveyor to move.

When the cartons have moved a sufficient distance so that the previously loaded carton is out of the way of the stop mechanisms 120 at that respective loading station, the feed stop mechanisms 120 now can return to their upward positions to await the arrival of their next containers 68. When that previously loaded container is out of the way, limit switch LS11 in line 39 senses this and closes, which energizes the carton stops in valve in line 39 whereupon the piston 122 will cause the stops 120 to come to the up position. In this wa, the carton or container stops move into the path of the cartons and out of the path of the cartons. This completes the description of the carton conveyor, trough assembly operation, and carton feed stop mechanisms.

Figure 25B:
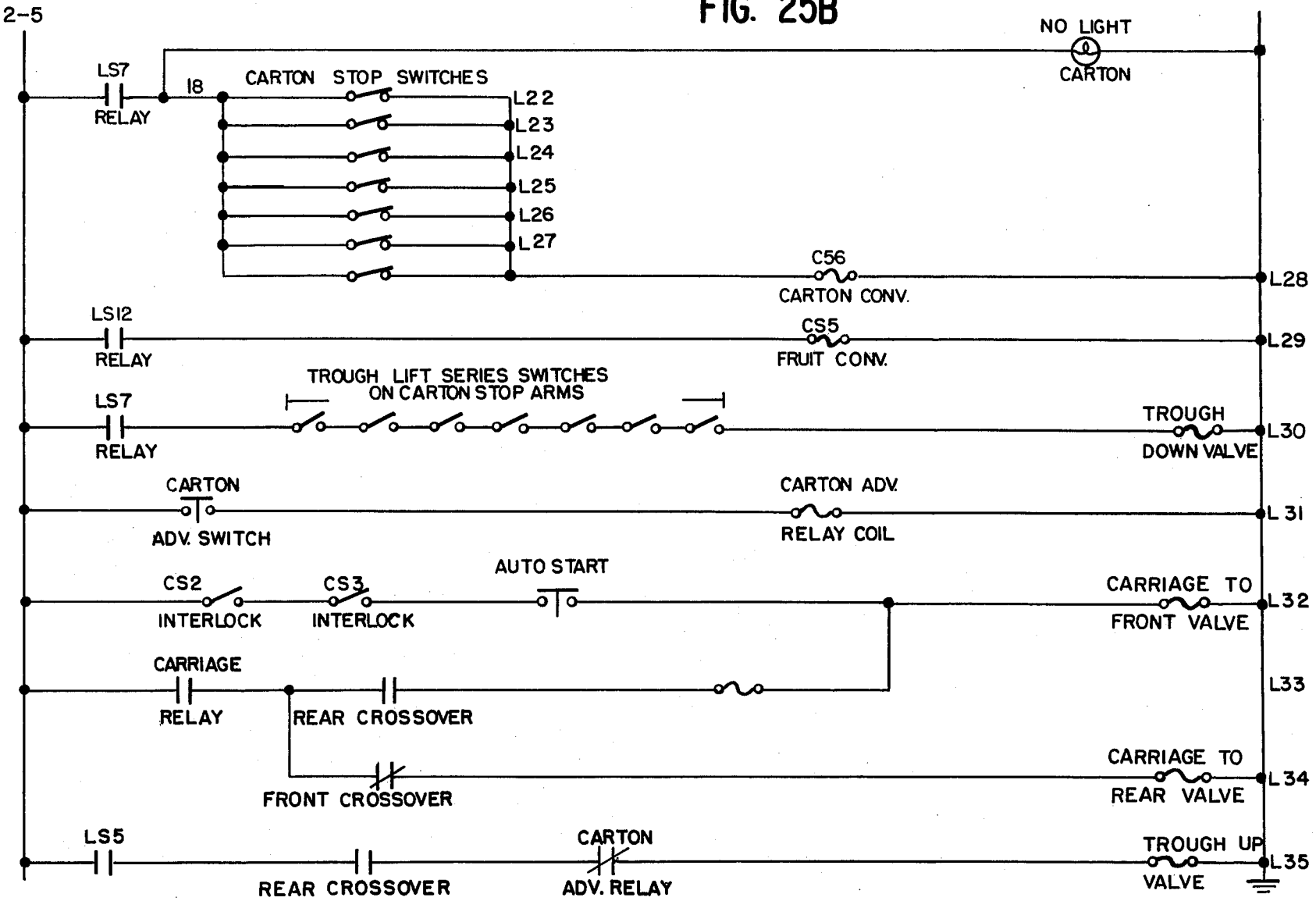
Figure 25C:
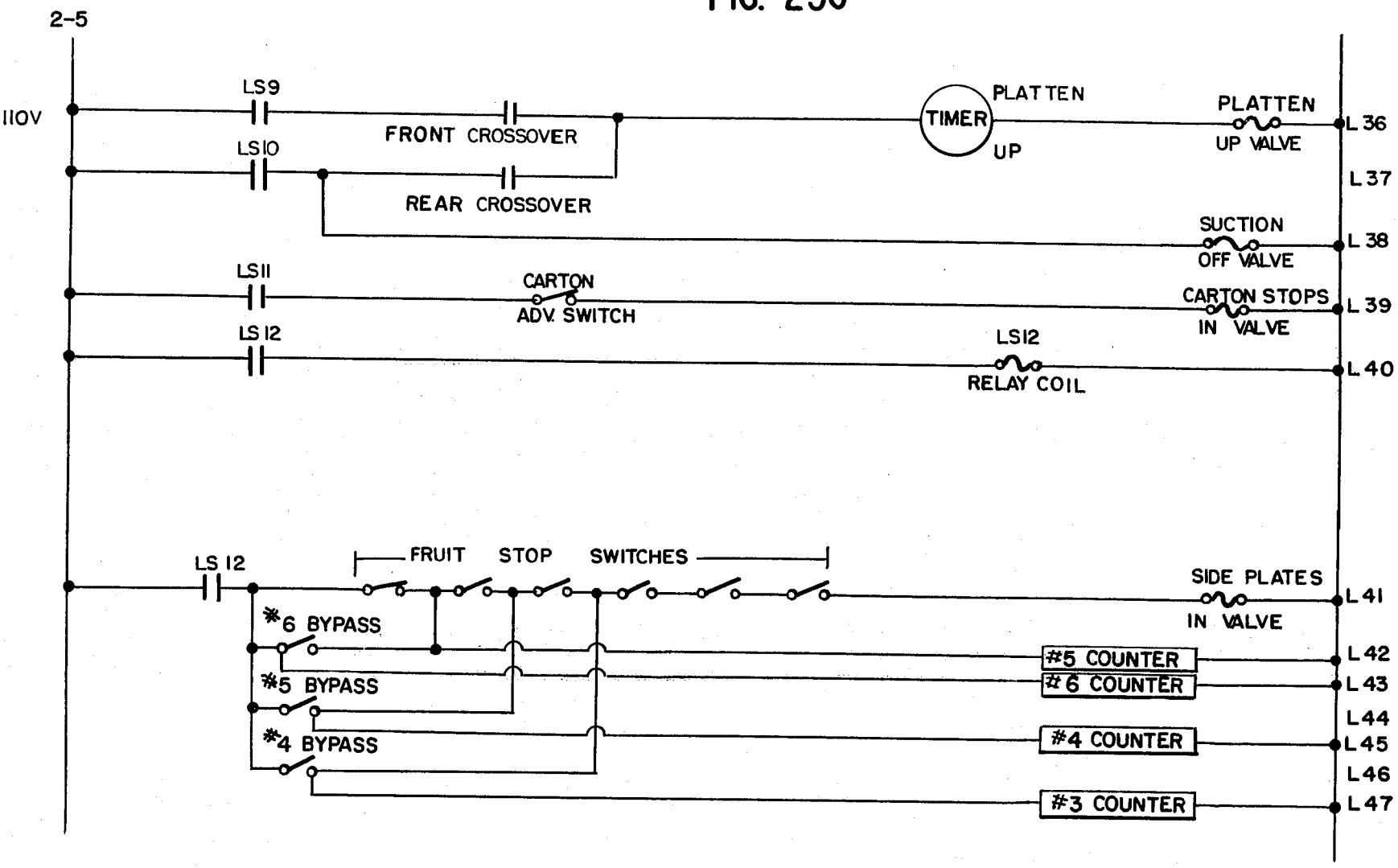

With reference to FIGS. 13 through 16, the electrical circuitry controlling the fruit conveyor means and the side panel nesting means will now be described in greater detail. With reference to line 29 of FIG. 25B, the fruit conveyor coil will be energized when the contacts LS12 in line 29 are closed.

The fruit conveyor will be energized whenever the fruit stop switches (line 41) are not depressed. This indicates a need for more fruit to be delivered up to the fruit stop switches or supply positions. When all of the fruit stop switches are engaged, the conveyor stops, and the side plates 60 move in in response to the piston 184 moving linkage 186 (line 41). When the side plates 60 are fully in, limit switch 12 closes and closes relay 12 (line 40). This closes the LS12 relay contact in line 5 which allows the platen down valve (line 4) to close. The platen operation has been previously discussed above.

After the fruit has been lifted by the fruit platen, the fruit conveyor advances to supply more fruit to the feed stop mechanisms. Also, the side plates 60 will have receded so as to not block the incoming fruit. As can be seen in lines 42 through 47, three by-pass switches enable the side plates in valve to close in response to less than all of the fruit stop switches 183 being closed at all of the supply positions. One or more of these switches will be closed if less than all six stations are operating. Counters are also provided which count the number of cycles the machine has gone through. these counters are illustrated in lines 42, 43, 45 and 47.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A machine for automatically packaging layers of articles into containers comprising:

container conveying means for disposing and advancing containers for receiving articles;

a plurality of loading stations adjacent said conveying means;

a plurality of supply positions adjacent to said loading stations, each supply position being associated with one of said loading stations;

means for disposing arrays of articles at said supply positions, each array comprising a predetermined number of articles;

means for sequentially loading said containers with a layer of articles generally at each loading station, from its associated supply position, comprising a platen assembly having article pickup means constructed and arranged to pick up the articles at the supply positions and deposit them in the container at the loading stations and wherein a different set of article pickup means is associated with each supply position and its associated loading station and means are provided for controlling the varying amount that each set of article pickup means descends into a container at that loading station.

2. The packaging machine in accordance with claim 1 wherein control means are provided for rendering certain loading means associated with certain article supply positions and loading positions selectively inoperative.

3. The packaging machine in accordance with claim 1 wherein trough means are provided associated with said loading stations for aligning said article loading means to a position above said containers at each loading station.

4. The packaging machine in accordance with claim 3 wherein trough movement means are provided for moving said trough means upward to facilitate the uninhibited movement of said containers by said container conveyor means and for moving said trough means downward on top of said containers when said containers are located generally at said loading stations.

* * * * *